US008418309B1

(12) United States Patent
Williams

(10) Patent No.: US 8,418,309 B1
(45) Date of Patent: Apr. 16, 2013

(54) PAINT TRAY AND ATTACHMENTS AND A METHOD OF USING THE SAME

(76) Inventor: Michael Williams, Toledo, OH (US)

( * ) Notice: Subject to any disclaimer, the term of this patent is extended or adjusted under 35 U.S.C. 154(b) by 170 days.

(21) Appl. No.: 12/904,183

(22) Filed: Oct. 14, 2010

(51) Int. Cl.
*B05C 21/00* (2006.01)

(52) U.S. Cl.
USPC ..... 15/257.06; 15/257.05; 220/23.4; 220/482; 220/570; 220/736; 220/751; 224/148.1; 224/148.7; 224/679; 224/680; 224/666

(58) Field of Classification Search ..... 15/257.05, 15/257.06; 206/361, 362.3; 220/23.8, 503, 220/505, 480, 482, 631, 570, 23.4, 736, 751; 224/679, 680, 904, 676–678, 666, 148.1–148.7; D32/53.1
See application file for complete search history.

(56) References Cited

U.S. PATENT DOCUMENTS

| | | | | | |
|---|---|---|---|---|---|
| 2,661,858 | A | * | 12/1953 | Howell | 15/257.06 |
| 2,694,825 | A | * | 11/1954 | Touchett et al. | 15/257.06 |
| 3,139,188 | A | * | 6/1964 | Goetz et al. | 211/133.6 |
| 3,351,970 | A | | 11/1967 | Engh | |
| 3,591,299 | A | * | 7/1971 | Pharris | 401/118 |
| D223,302 | S | | 4/1972 | Golden | |
| 4,199,836 | A | * | 4/1980 | Lovmark | 15/257.06 |
| 4,854,470 | A | * | 8/1989 | Ireland | 220/697 |
| 5,201,439 | A | * | 4/1993 | Davies | 220/735 |
| 5,489,051 | A | * | 2/1996 | Robinson | 224/148.4 |
| 5,493,751 | A | * | 2/1996 | Misiukowiec et al. | 15/257.06 |
| 5,695,098 | A | | 12/1997 | King | |
| 5,836,043 | A | * | 11/1998 | Rovas | 15/257.06 |
| 6,283,345 | B1 | | 9/2001 | Butschat | |
| 6,513,771 | B1 | * | 2/2003 | Tucker | 248/211 |
| 6,622,340 | B2 | * | 9/2003 | Rosa | 15/257.06 |
| 6,866,172 | B2 | * | 3/2005 | Shackelford | 224/148.4 |
| 7,774,893 | B2 | * | 8/2010 | Keane | 15/257.06 |
| 2003/0089748 | A1 | | 5/2003 | Whalen | |
| 2003/0111497 | A1 | | 6/2003 | Lukaris | |
| 2004/0007578 | A1 | * | 1/2004 | Richards | 220/570 |
| 2007/0204423 | A1 | * | 9/2007 | Keane | 15/257.06 |

FOREIGN PATENT DOCUMENTS

| | | | |
|---|---|---|---|
| EP | 1457357 | * | 9/2004 |
| GB | 2292309 | * | 2/1996 |
| GB | 2358177 | * | 7/2001 |
| GB | 2386362 | * | 9/2003 |
| GB | 2397567 | * | 7/2004 |

* cited by examiner

*Primary Examiner* — Mark Spisich
(74) *Attorney, Agent, or Firm* — Marshall & Melhorn, LLC

(57) ABSTRACT

A tray for paint or other coatings may be disposed on a horizontal surface and also may be suspended vertically, for example from the belt or waistband of a user. The tray is especially adapted to be used in a vertical orientation with a roller-type coating applicator, and comprises a front wall, back wall, oppositely disposed side walls and a bottom wall cooperating to define a coating receptacle, with the front wall, back wall, and side walls each having a top edge cooperating to define an open top of the coating receptacle. The tray is adapted to be suspended by a bracket at the side of a user, for example by the belt and/or waistband of the user.

8 Claims, 14 Drawing Sheets

PAINT TRAY AND ATTACHMENTS AND A METHOD OF USING THE SAME

RELATED APPLICATION

This application is claiming the benefit, under 35 U.S.C. §119(e), of the provisional application filed Oct. 15, 2009 under 35 U.S.C. §111(b), which was granted Ser. No. 61/279,117. This provisional application is hereby incorporated by reference in its entirety.

FIELD OF THE INVENTION

The present invention relates to a paint tray and, more particularly, to a paint tray that may be disposed on a horizontal surface and also may be suspended vertically, for example from the belt or waistband of a user. The invention further relates to combinations of the paint tray with a floor stand attachment and a roller/brush holder attachment.

DETAILED DESCRIPTION OF THE PREFERRED EMBODIMENTS

Figure 1:
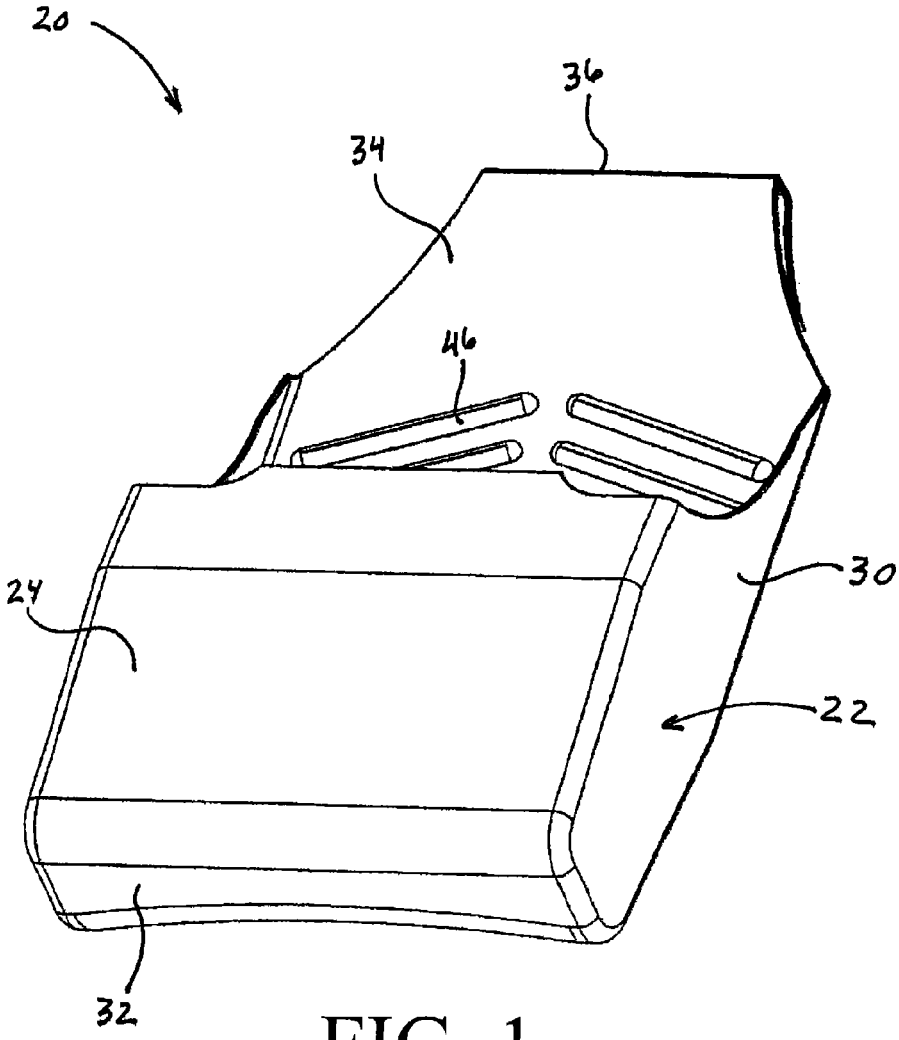
FIG. 1 is a perspective view of the paint tray of the invention.

Referring now to FIGS. 1-6, a paint tray denoted generally by reference numeral 20 includes a paint receptacle 22 defined by a front wall 24, a back wall 26, a first side wall 28, a second side wall 30, and a bottom wall 32. The top edges of the front wall 24 and first and second side walls 28, 30 define the open top of the paint receptacle 22.

The back wall 26 of the paint tray 20 is longer than the front wall 24. The side walls 28, 30 have an upper edge that is angled from the back wall 26 downwardly toward the front wall 24. The back wall 26 has an upper end 34 that narrows inwardly from the sidewalls 28, 30 to a reduced width top edge 36. A downwardly facing generally L-shaped bracket 38 extends from the top edge 36 of the back wall 26. The L-shaped bracket 38 includes a relatively short first leg 40 and a longer leg 42. As the length of the top edge 36 is significantly less than the width of the receptacle 22, and the first leg 40 of the L-shaped bracket 38 is relatively short, the paint tray 20 may be readily suspended vertically from, for example, a belt or waistband at the side of one using the paint tray. When vertically suspended, a vertical support section 43 of the back wall, which is generally parallel with the longer leg 42 of the L-shaped bracket 38, will typically abut the vertical surface beneath which the paint tray is suspended.

Figure 7:
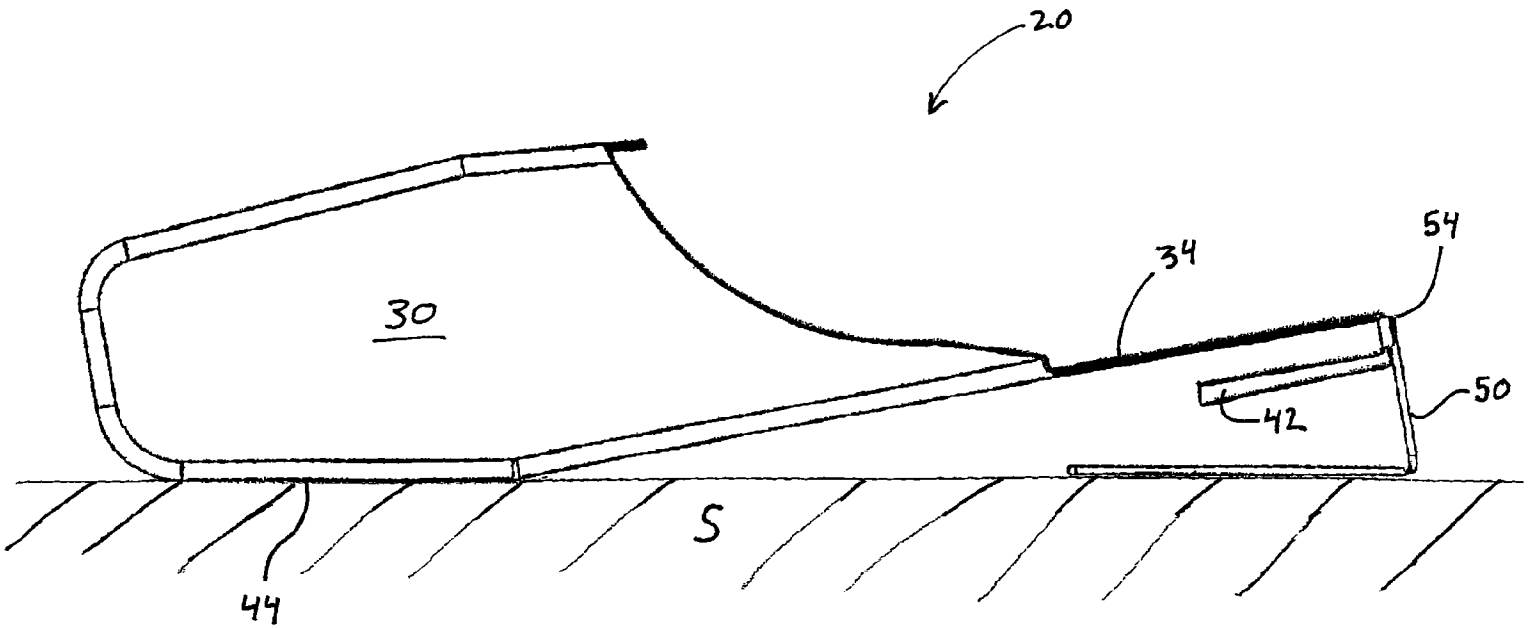
FIG. 7 is a side view of the paint tray of FIG. 2, with a floor stand attachment, resting on a surface S.
Figure 16:
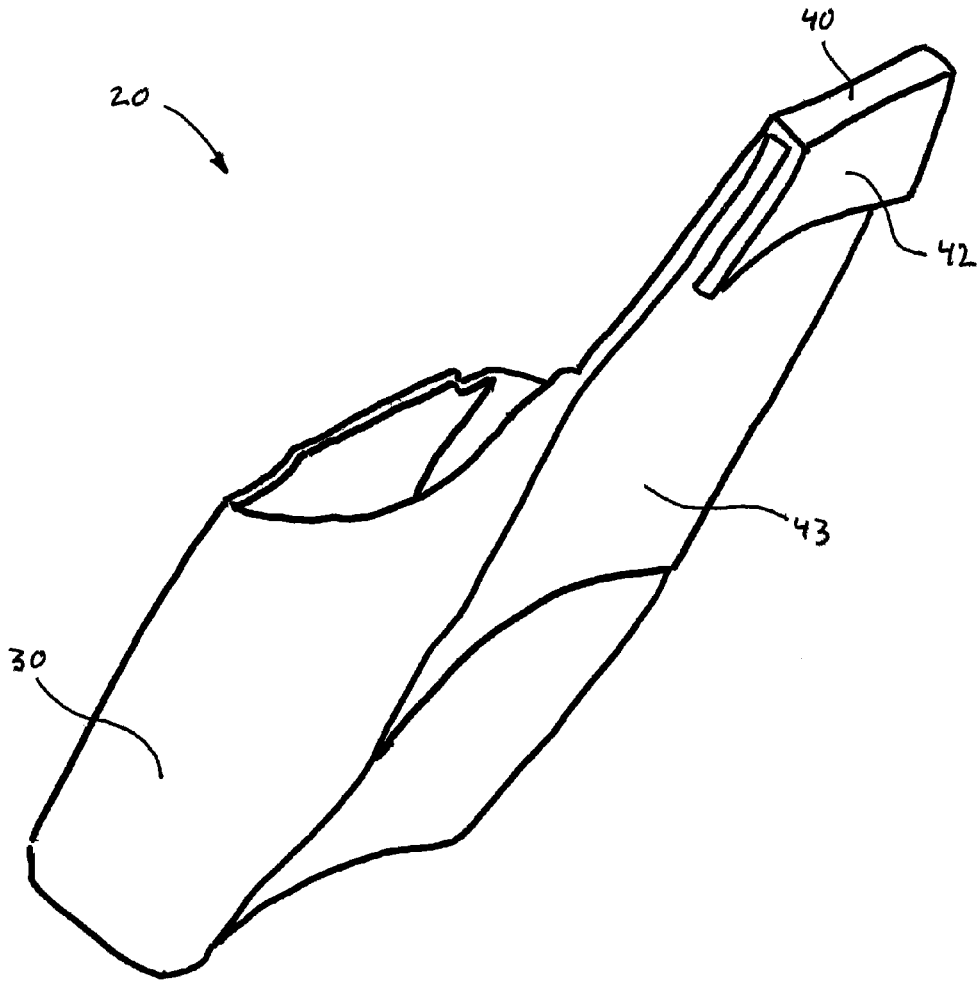
FIG. 16 is another perspective view of the paint tray of FIG. 15.

The back wall 26 of the paint tray further includes a horizontal support section 44 on which the paint tray 20 rests, in part, when it is desired to rest the paint tray on a generally horizontal surface, such as the surface S, shown in FIG. 7. The vertical support section 43 and the horizontal support section 44 preferably meet one another at an angle slightly less than 180 degrees, with the horizontal support section 44 angling slightly towards the front wall 24 of the paint tray 20. As best shown in FIG. 16, in a preferred embodiment the horizontal support section 44 are somewhat concave in shape so as to more comfortably fit to the side of the user when the tray is suspended vertically from the belt or waistband of such user. The leg 42 of the L-shaped bracket 38 may be similarly shaped for the same reason.

Figure 2:
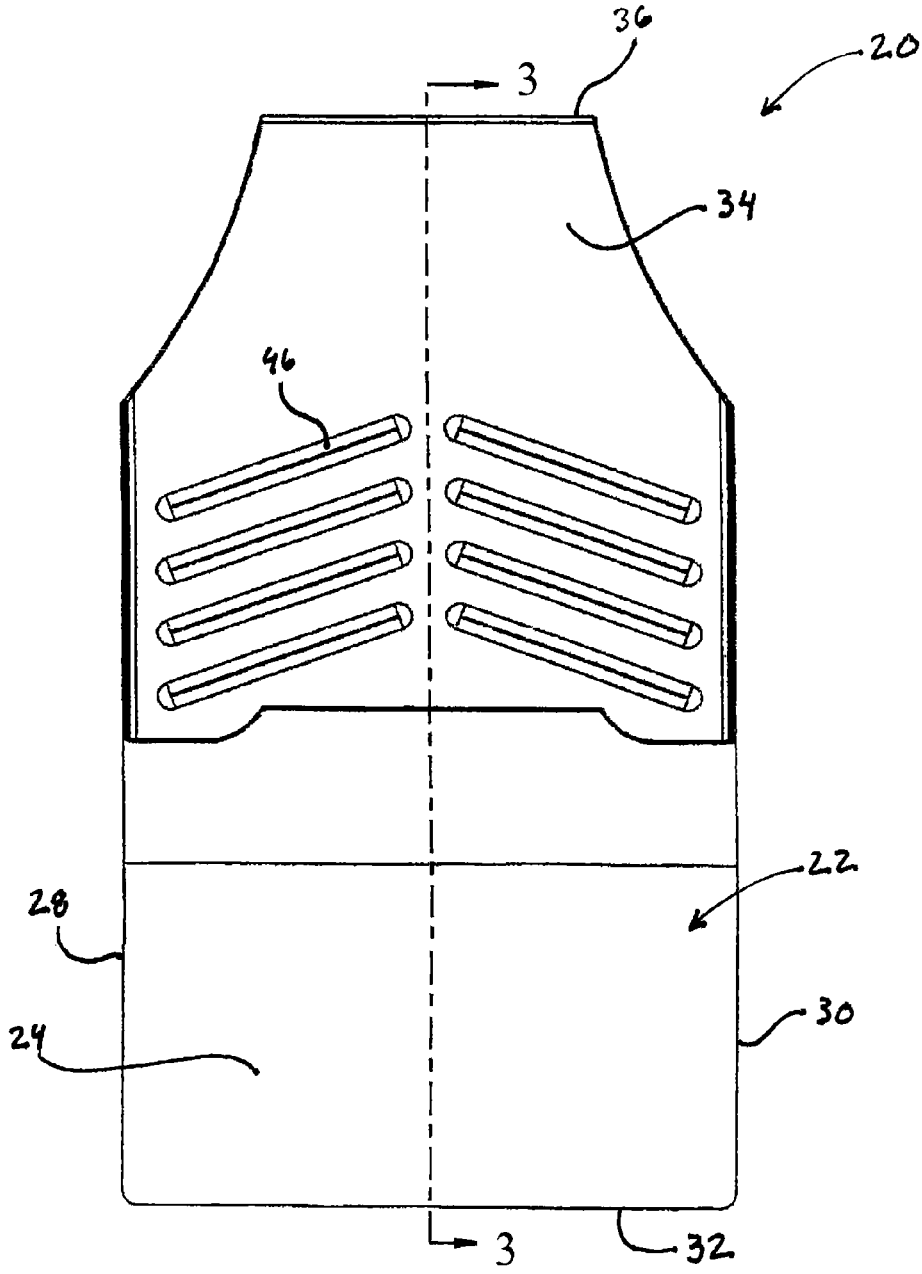
FIG. 2 is a front view of the paint tray shown in FIG. 1
Figure 3:
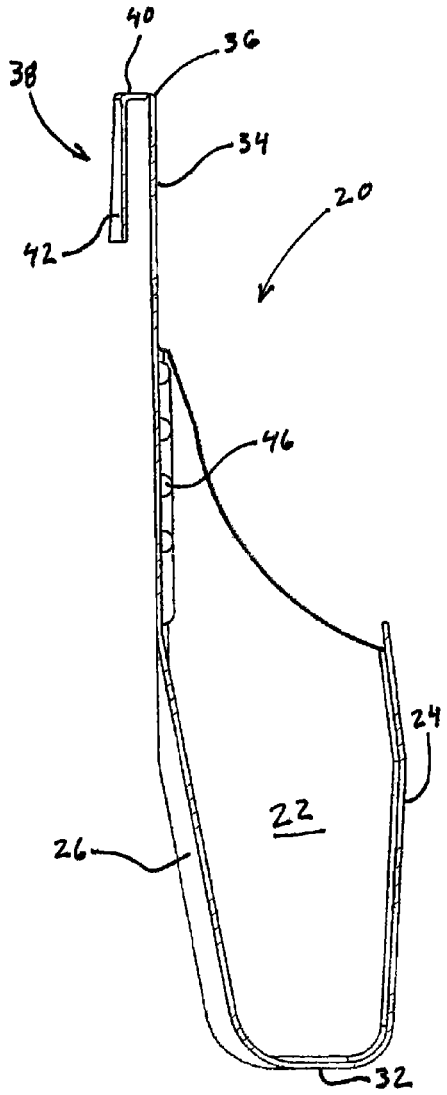
FIG. 3 is a sectional view of the paint tray taken along the line A-A of FIG. 2.
Figure 4:
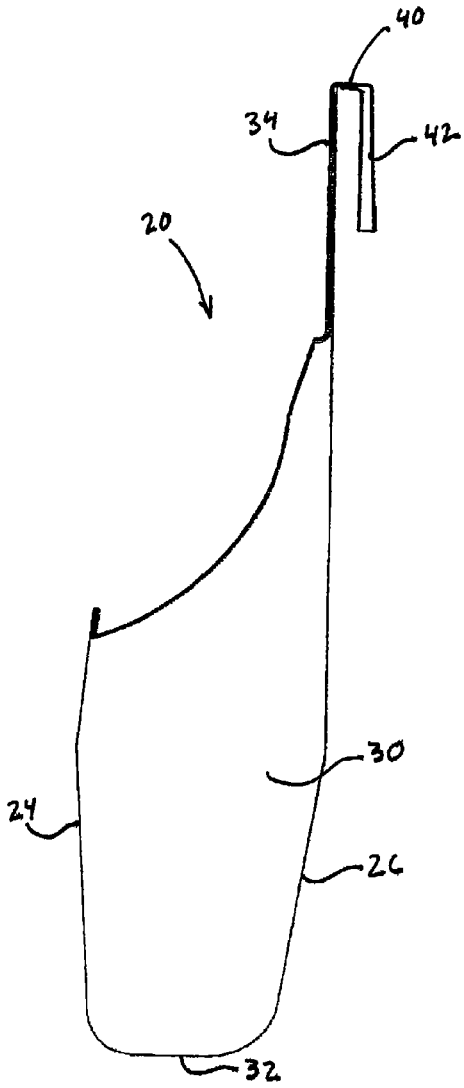
FIG. 4 is right side view of the paint tray shown in FIG. 2.
Figure 5:
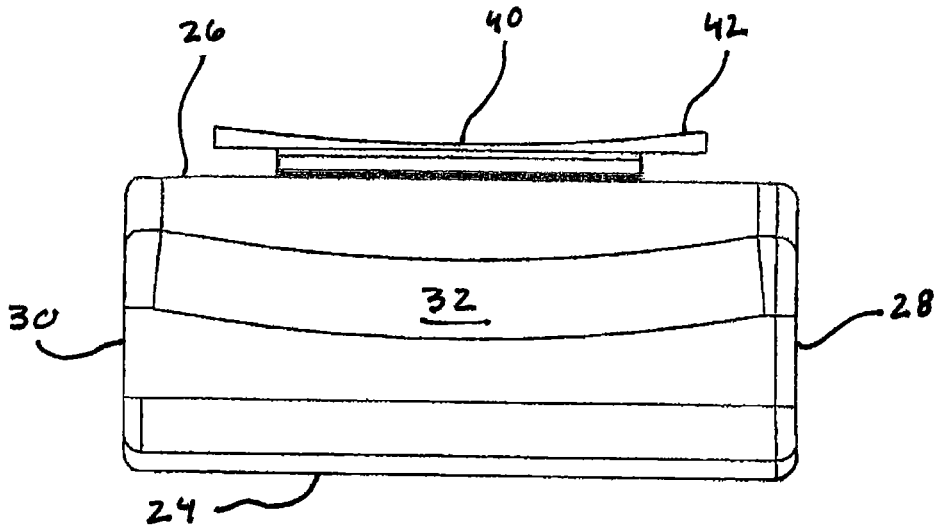
FIG. 5 is a bottom view of the paint tray shown in FIG. 2.
Figure 6:
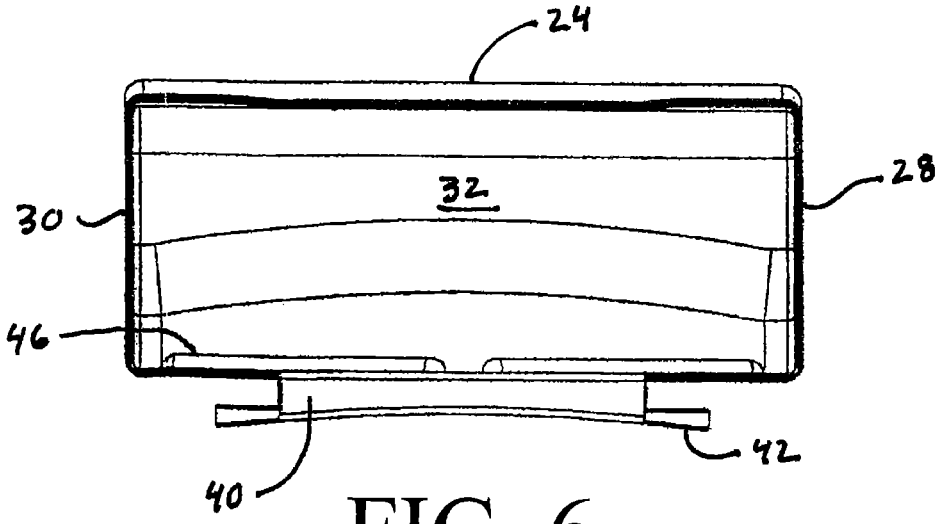
FIG. 6 is a top view of the paint tray shown in FIG. 2.
Figure 15:
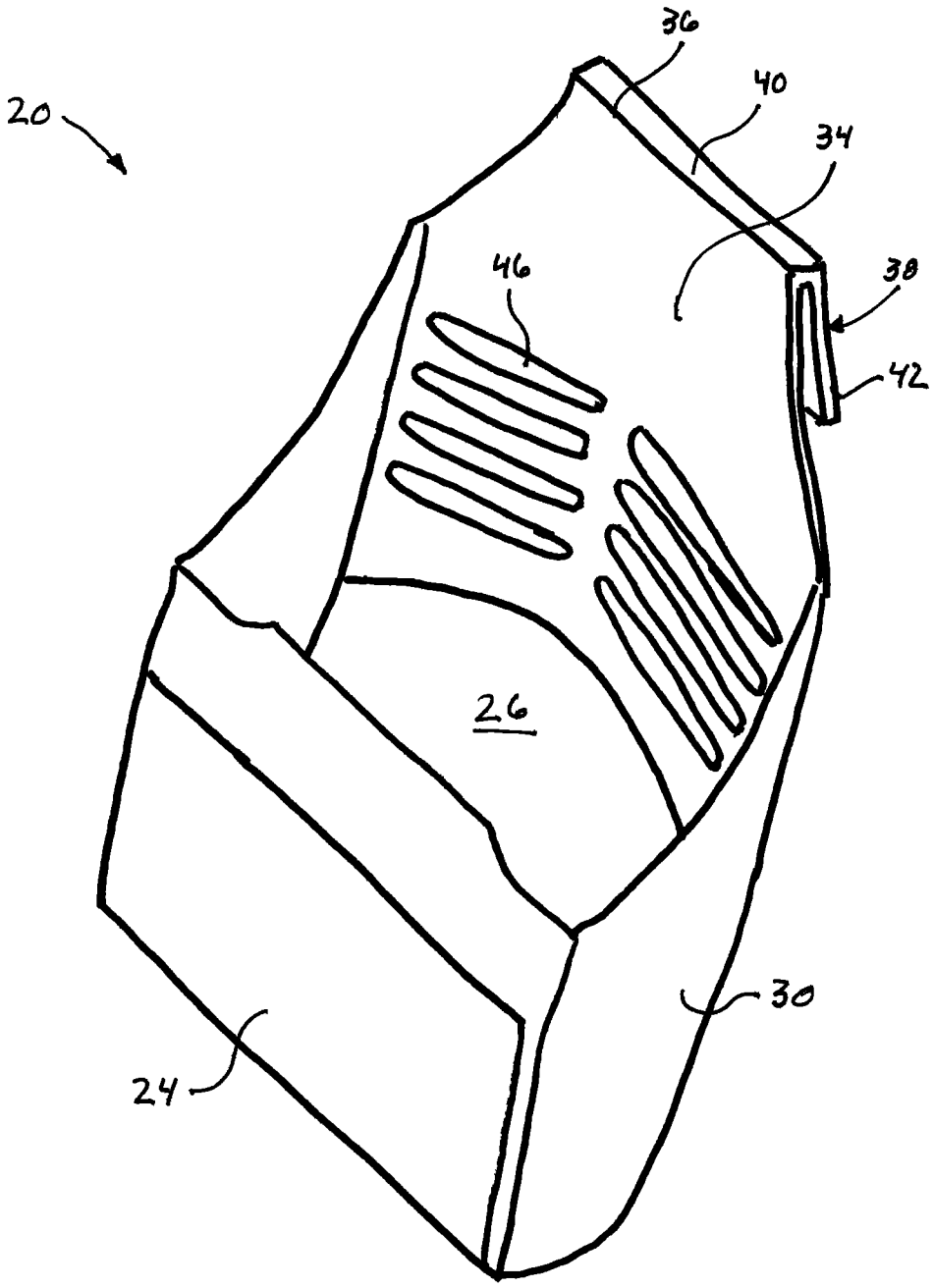
FIG. 15 is perspective view of an embodiment of the paint tray of the invention.

When supported on the horizontal surface S, the paint tray 20 retains the paint within the receptacle 22 and a paint roller or paint brush (neither of which is shown) can be used. The back wall 26 is also preferably provided with a plurality of spaced apart raised members 46 formed thereon to assist in the removal of excess paint from a paint roller. The raised members 46 may be formed as two rows of ribs that are angled downwardly from the center of the back wall 26 towards the sidewalls 28, 30, as best illustrated in FIGS. 2 and 15. Of course, the raised members 46 may have any desired shape effective for removal of excess paint as the roller is passed thereover.

As also shown in FIG. 7, a floor stand attachment 48 may be selectively secured to the L-shaped bracket 38 when the paint tray is to be supported on a generally horizontal surface S. With the paint tray 20 resting on the section 44 of the back wall 26 and the floor stand attachment 48, the upper end of the paint tray 20 is raised relative to the bottom, so that the paint or other coating liquid is retained within the receptacle 22. The floor stand attachment 48 may also be used to suspend the tray 20 vertically from the rung of a ladder (not shown).

Figure 8:
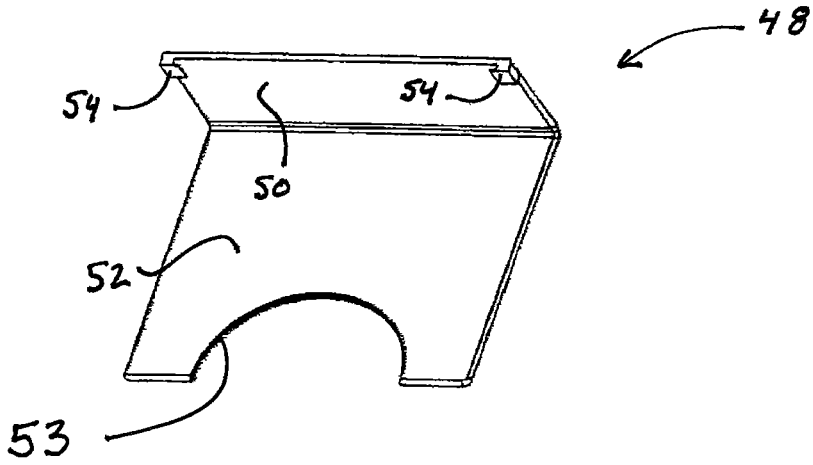
FIG. 8 is a perspective view of the floor stand attachment shown in FIG. 7.
Figure 9:
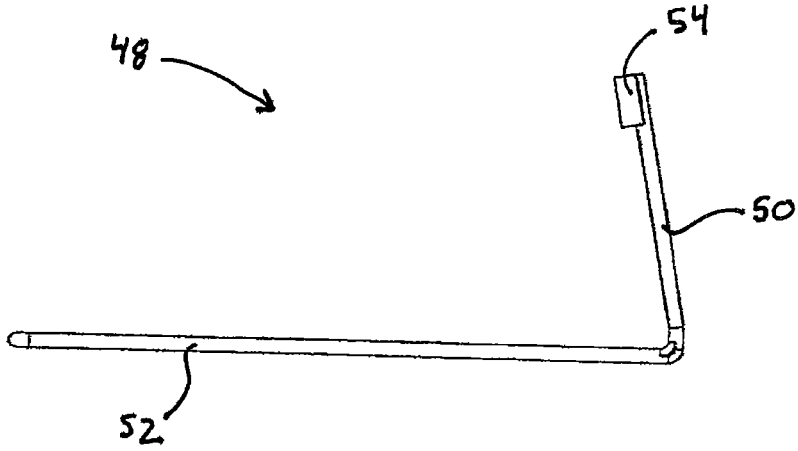
FIG. 9 is an enlarged side view of the floor stand attachment shown in FIG. 8.
Figure 10:
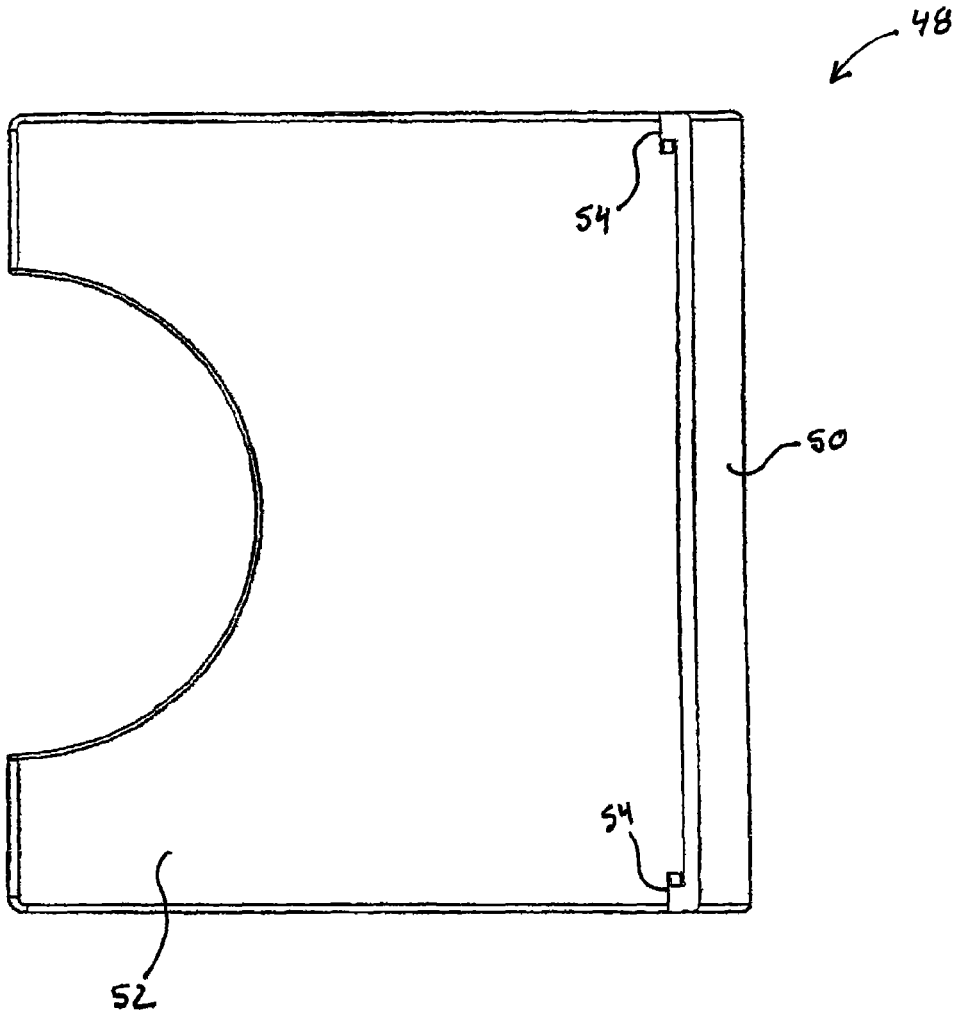
FIG. 10 is an enlarged top view of the floor stand attachment shown in FIG. 8.
Figure 18:
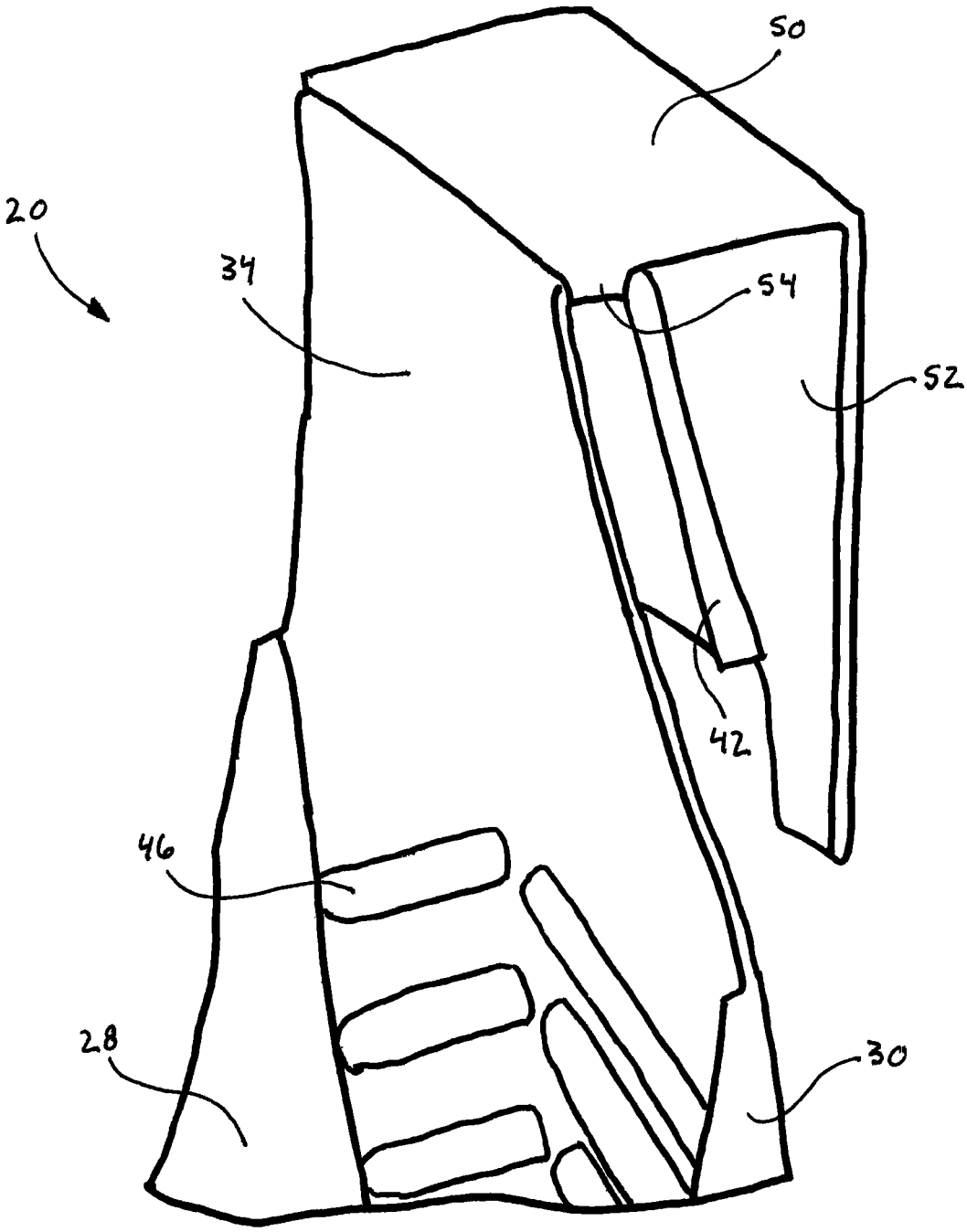
FIG. 18 is an enlarged perspective view of a portion of the paint tray of FIG. 15 having a floor stand attachment secured thereto.

The floor stand attachment 48, shown in more detail in FIGS. 8-10, is generally L-shaped, including a first leg 50 and a second leg 52, the angle between the two preferably being slightly less than 90 degrees. In the illustrated embodiment, the end of the first leg 50 is provided with a pair of flexible, inwardly facing lips 54 adapted to snap-fit over the first leg 40 of the L-shaped bracket 38, as best seen in FIG. 18. With the lips 54 of the floor stand attachment 48 abutting the upper end 34 of the back wall 26 of the paint tray 20 and the second leg 52 of the floor stand attachment 48 resting on the surface S, the floor stand attachment 48 serves to support the upper end of the paint tray 20 in a position elevated above the surface S. The second leg 52 may be provided with a generally semi-circular cut-out 53 that can be used, after the attachment 48 has been detached from the tray, to clean excess paint off of the roller.

Figure 11:
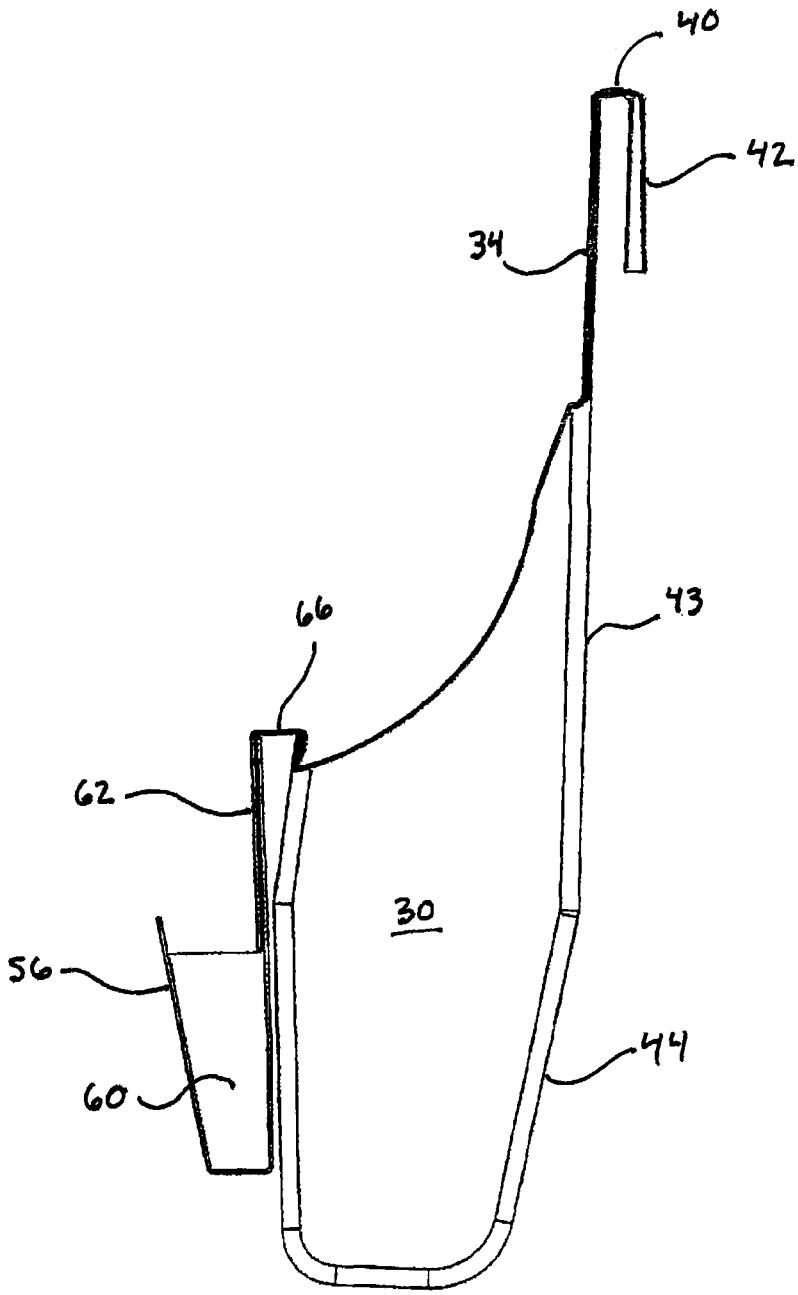
FIG. 11 is a side view of the paint tray of the invention with a roller/brush holder attachment.
Figure 12:
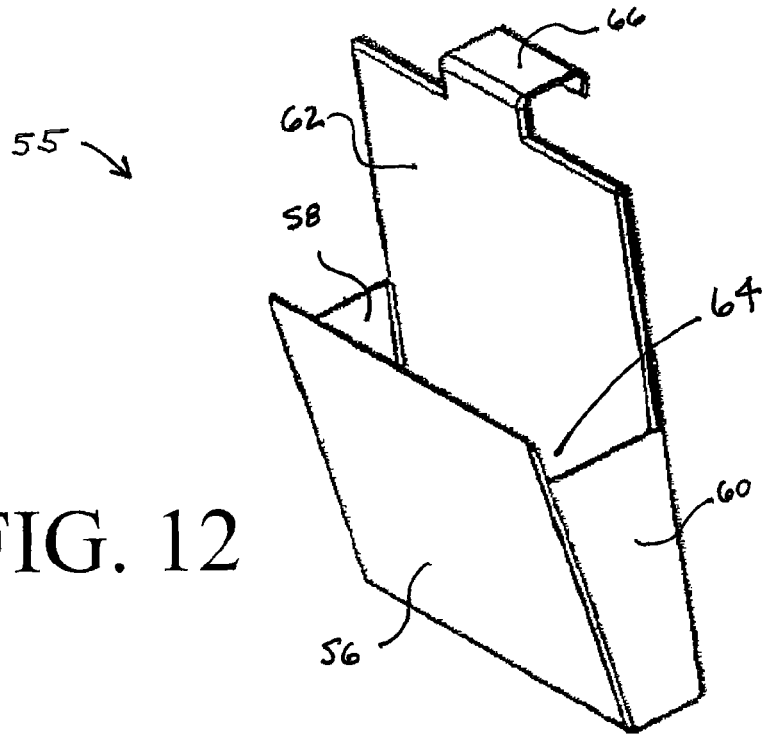
FIG. 12 is a perspective view of the roller/brush holder attachment shown in FIG. 11.
Figure 13:
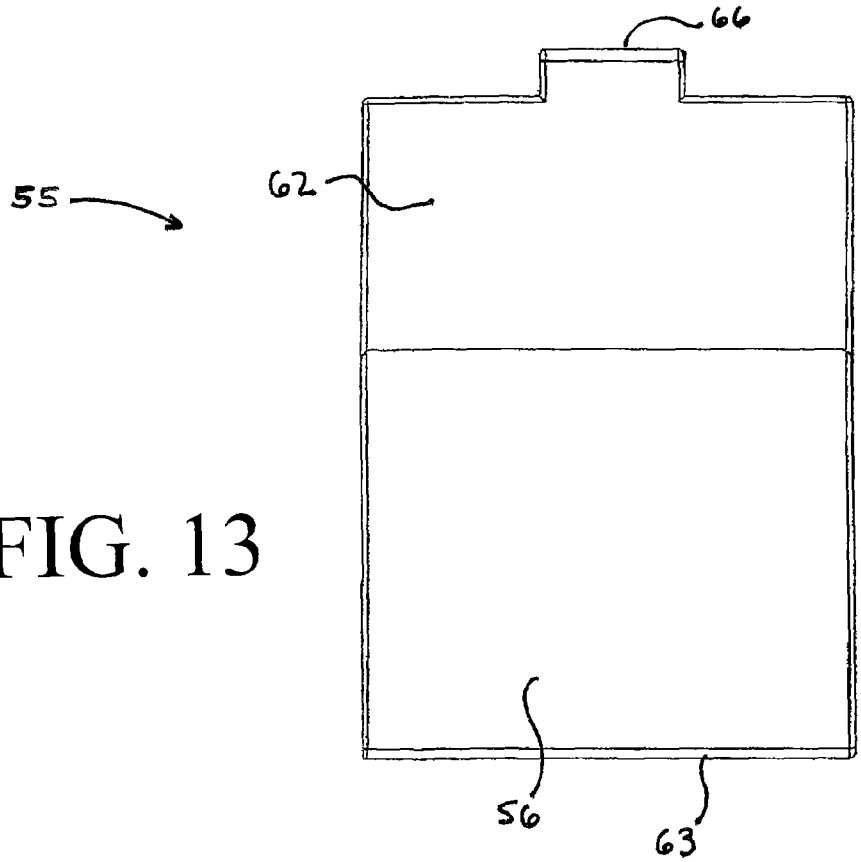
FIG. 13 is an enlarged front view of the roller/brush holder attachment shown in FIG. 12.
Figure 14:
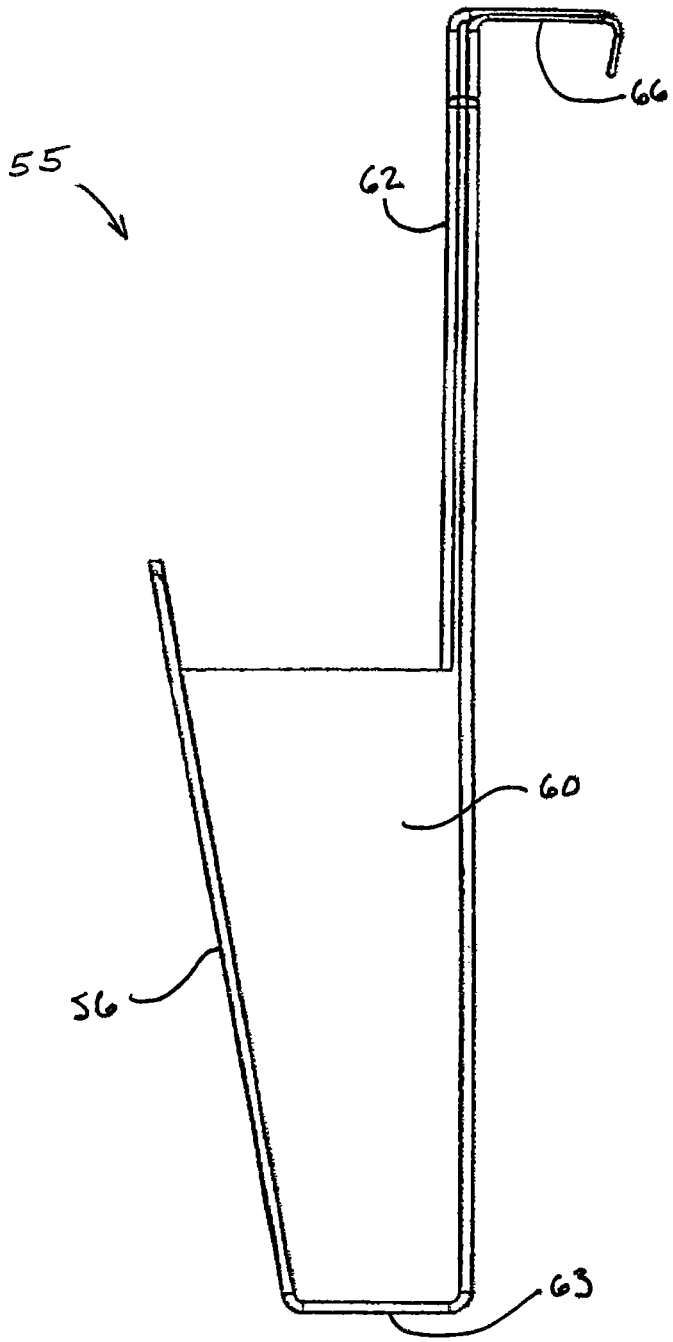
FIG. 14 is an enlarged side view of the roller/brush holder attachment shown in FIG. 12.

As shown in FIG. 11, the paint tray 20 of the invention may also be provided with a roller/brush holder attachment 55 that may be selectively secured thereto. The roller/brush holder attachment 55 itself is shown in more detail in FIGS. 12-14. The attachment 55 includes a front wall 56, side walls 58 and 60, a back wall 62 and a bottom wall 63, all of which together define a roller/brush receptacle 64. The receptacle 64 is adapted to receive the end of a brush with the handle extending upward or to receive the U-shaped wire portion that extends between the handle and the roller in a roller assembly.

Figure 17:
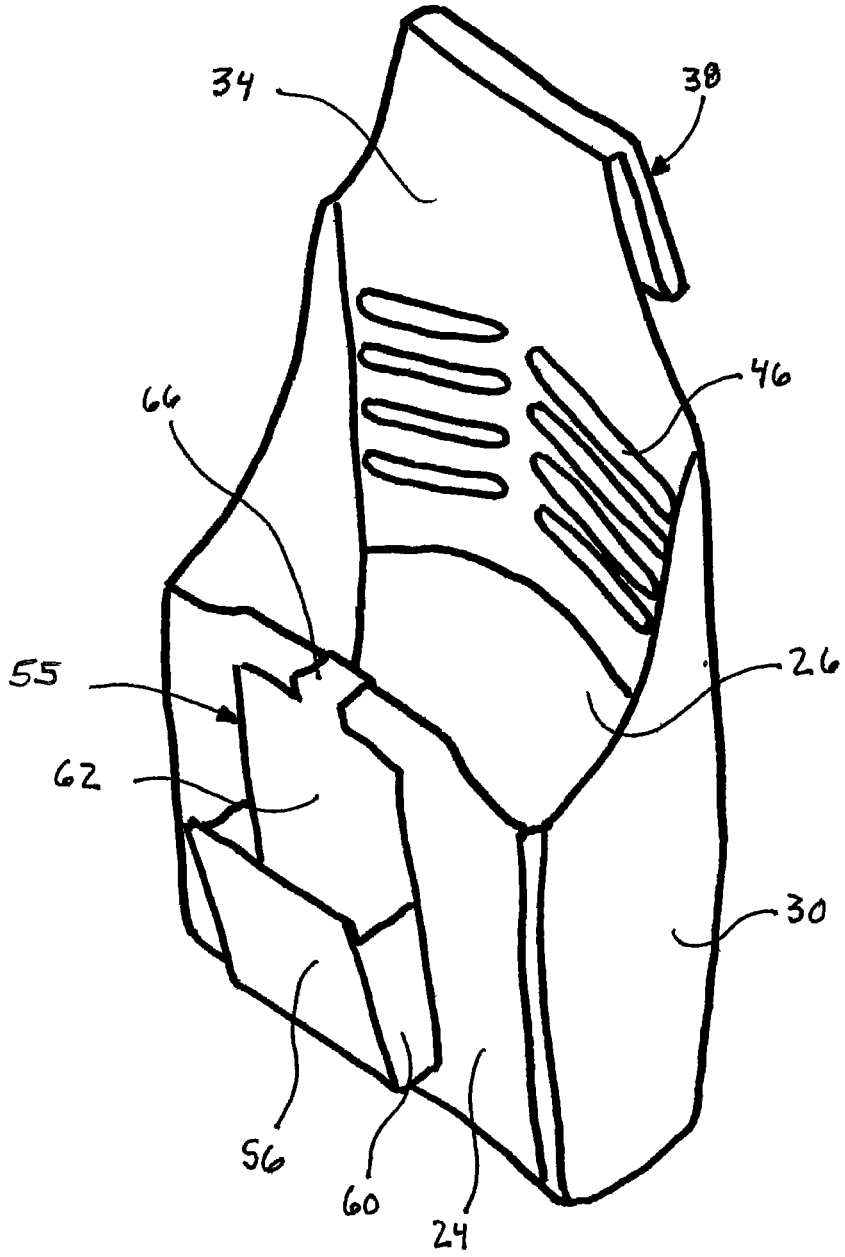
FIG. 17 is a perspective of the paint tray of FIG. 15 with the roller/brush holder attachment secured thereto.

The back wall 62 of the attachment 55 preferably extends upwardly beyond the top edges of the remaining walls. In addition, the middle of the upper edge of the back wall 62 is provided with a hook member 66 that extends over the top edge of the front wall 24 of the paint tray 20, thereby retaining the roller/brush attachment 55 to the paint tray 20, as shown in FIGS. 11 and 17. Due to the structure of the roller/brush holder attachment 55, it may also be suspended, for example, from the lip of the opening of a paint can (not shown).

The paint tray 20 of the invention may be formed of a metal, plastic or any other material known for use in forming conventional paint trays. A preferred metal for forming the paint tray 20 is aluminum. Most preferably, the paint tray 20 is formed of a light, strong, chemically inert plastic material, and is it is especially preferred to mold the paint tray as a monolithic part. The floor stand attachment 48 and roller/brush attachment 55 may be formed of like materials to those suitable for forming the paint tray 20 itself.

In accordance with the provisions of the patent statutes, the invention has been described in what is considered to represent its preferred embodiments. However, it should be noted that the invention can be practiced otherwise than as specifically illustrated and described without departing from its spirit or scope. For example, the invention may be used in connection with the application of liquid coatings other than paints, such as a liquid adhesive, to a surface.

What is claimed is:

1. A coatings tray adapted to be used in a vertical orientation with a roller-type coating applicator, comprising a front wall, back wall, oppositely disposed side walls and a bottom wall cooperating to define a coating receptacle, with the front wall, back wall, and side walls each having a top edge cooperating to define an open top of the coating receptacle, a floor stand attachment selectively secured to the back wall so as to raise the top edge of the back wall when the coatings tray is supported on a generally flat, horizontal surface, and a generally L-shaped bracket extending from the back wall proximate the top edge thereof, the bracket comprising a relatively short first leg extending outwardly from the back wall and a relatively longer second leg extending from the first leg in a direction generally parallel to the back wall, wherein the floor stand attachment is selectively secured to the back wall via the generally L-shaped bracket.

2. The coatings tray of claim 1, wherein the top edge of the back wall has a width significantly less than the width of the back wall extending between the respective side walls.

3. The coatings tray of claim 1, wherein the back wall narrows inwardly from the side walls to the top edge of the back wall.

4. The coatings tray of claim 1, wherein the back wall is comprised of a vertical support section extending downwardly from the top edge of the back wall and a horizontal support section extending upwardly from the bottom wall, with the horizontal support section angling away from a plane defined generally by the vertical support section towards the front wall.

5. A coatings tray adapted to be used in a vertical orientation with a roller-type coating applicator, comprising a front wall, back wall, oppositely disposed side walls and a bottom wall cooperating to define a coating receptacle, with the front wall, back wall, and side walls each having a top edge cooperating to define an open top of the coating receptacle, a generally L-shaped bracket extending from the back wall proximate the top edge thereof, the bracket comprising a relatively short first leg extending outwardly from the back wall and a relatively longer second leg extending from the first leg in a direction generally parallel to the back wall, and a floor stand attachment selectively secured thereto so as to raise the top edge of the back wall when the coatings tray is supported on a generally flat, horizontal surface.

6. The coatings tray of claim 5, wherein the top edge of the back wall has a width significantly less than the width of the back wall extending between the respective side walls.

7. The coatings tray of claim 6, wherein the back wall narrows inwardly from the side walls to the top edge of the back wall.

8. The coatings tray of claim 5, wherein the back wall is comprised of a vertical support section extending downwardly from the top edge of the back wall and a horizontal support section extending upwardly from the bottom wall, with the horizontal support section angling away from a plane defined generally by the vertical support section towards the front wall.

* * * * *